US012552500B2

(12) United States Patent
Tsai et al.

(10) Patent No.: US 12,552,500 B2
(45) Date of Patent: Feb. 17, 2026

(54) POWER-FREE PASSIVE STABILIZING DEVICE AND SYSTEM WORKING AT INTERFACE OF DIFFERENT MEDIA

(71) Applicant: National Tsing Hua University, Hsinchu (TW)

(72) Inventors: Hung-Yin Tsai, Hsinchu (TW); Shang-Ru Wu, Taichung (TW); Shang-Yi Kung, Taipei (TW); Cheng-Yang Li, Chiayi (TW); Yu-Cheng Wu, Taipei (TW); Yu-Ting Su, Taipei (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 426 days.

(21) Appl. No.: 18/320,712

(22) Filed: May 19, 2023

(65) Prior Publication Data

US 2024/0317367 A1 Sep. 26, 2024

(30) Foreign Application Priority Data

Mar. 24, 2023 (TW) ..... 112111298

(51) Int. Cl.
*B63B 39/03* (2006.01)

(52) U.S. Cl.
CPC ..... *B63B 39/03* (2013.01)

(58) Field of Classification Search
CPC ..... B63B 39/03; B63B 39/02; B63B 39/00
See application file for complete search history.

(56) References Cited

U.S. PATENT DOCUMENTS

| | | | | |
|---|---|---|---|---|
| 4,176,614 | A * | 12/1979 | Goss | B63B 39/03 405/200 |
| 4,864,958 | A * | 9/1989 | Belinsky | B63B 13/00 114/265 |
| 6,761,124 | B1 | 7/2004 | Srinivasan | |
| 6,910,438 | B2 * | 6/2005 | Leverette | B63B 39/005 114/265 |
| 2018/0141622 | A1 | 5/2018 | Zhou | |

FOREIGN PATENT DOCUMENTS

| | | | |
|---|---|---|---|
| CN | 205574227 | U | 9/2016 |
| CN | 211731745 | U | 10/2020 |
| CN | 113086106 | A | 7/2021 |
| WO | 2017005103 | A1 | 1/2017 |

* cited by examiner

*Primary Examiner* — Michael L Sehn
(74) *Attorney, Agent, or Firm* — Muncy, Geissler, Olds & Lowe, P.C.

(57) ABSTRACT

A power-free passive stabilizing device working at an interface of different media includes a hollow chamber body, a limiting structure and a valve cover. The hollow chamber body has a first end, a second end, a first opening at the first end and a second opening at the second end. The limiting structure is connected to the first end of the hollow chamber body. The valve cover is limited by the limiting structure and movably disposed on the first end of the hollow chamber body to close and open the first opening. A passive stabilizing system using the passive stabilizing device is also disclosed.

9 Claims, 6 Drawing Sheets

POWER-FREE PASSIVE STABILIZING DEVICE AND SYSTEM WORKING AT INTERFACE OF DIFFERENT MEDIA

CROSS-REFERENCE TO RELATED APPLICATIONS

This application claims priority of No. 112111298 filed in Taiwan R.O.C. on Mar. 24, 2023 under 35 USC 119, the entire content of which is hereby incorporated by reference.

FIELD OF THE INVENTION

This disclosure relates to a stabilizing device and a stabilizing system, and more particularly to a power-free passive stabilizing device and a system working at an interface of different media.

DESCRIPTION OF RELATED ART

Boats and ships play very important roles in the transportation of people and goods. The boats and ships sailing on the sea need to maintain stability under the action of wind and waves. Therefore, stabilizing mechanisms are required to avoid the risk of capsizing of the boats and ships.

In general, a ballast, such as water or a lead block, functions as a stabilizing mechanism of the boat or ship. The utilization of the lead block causes the too-heavy problem, and the lead block cannot be conveniently carried. When the ballast water is utilized, active devices, such as pumping and draining devices, are required to pump and drain the water. Therefore, the overall mechanism becomes complicated, and the active control mechanism and power are required, so the cost is high.

As a result, how to provide a low-cost passive stabilizer having a simple structure to facilitate various application occasions is indeed a problem to be solved by this disclosure.

SUMMARY OF THE INVENTION

It is therefore an objective of this disclosure to provide a power-free passive stabilizing device and a power-free stabilizing system working at an interface of different media to have advantages of self stabilization, simple structure and low cost.

To achieve the above-identified objective, this disclosure provides a power-free passive stabilizing device including a hollow chamber body, a limiting structure and a valve cover. The hollow chamber body has a first end, a second end, a first opening at the first end and a second opening at the second end. The limiting structure is connected to the first end of the hollow chamber body. The valve cover is limited by the limiting structure and movably disposed on the first end of the hollow chamber body to close and open the first opening.

This disclosure also provides a power-free passive stabilizing system including: a frame structure; and one or multiple ones of the power-free passive stabilizing devices mounted on the frame structure.

The above-mentioned embodiment works in an environment including a first medium and a second medium. A density of the first medium is smaller than a density of the second medium, and an interface is formed between the first medium and the second medium. When the second opening of the hollow chamber body is moved from the first medium to the second medium through the interface, the second medium squeezes the first medium in the hollow chamber body, so that the first medium pushes the valve cover to open the first opening and flows out of the first opening. When the hollow chamber body is forced such that the first opening of the hollow chamber body tends to move from the second medium to the first medium through the interface, the valve cover closes the first opening to utilize the second medium in the hollow chamber body to provide an auxiliary inertial mass to keep the hollow chamber body stable in the second medium. The passive stabilizing device has an anti-overturn mechanism that can be easily carried to provide the great stabilizing effect, and can also drain the medium obtained from the environment, so that the overall mechanism is extremely light weighted and can be conveniently carried, and the cost is low.

In order to make the above-mentioned content of this disclosure more obvious and be easily understood, preferred embodiments will be described in detail as follows in conjunction with the accompanying drawings.

DETAILED DESCRIPTION OF THE INVENTION

Figure 1:
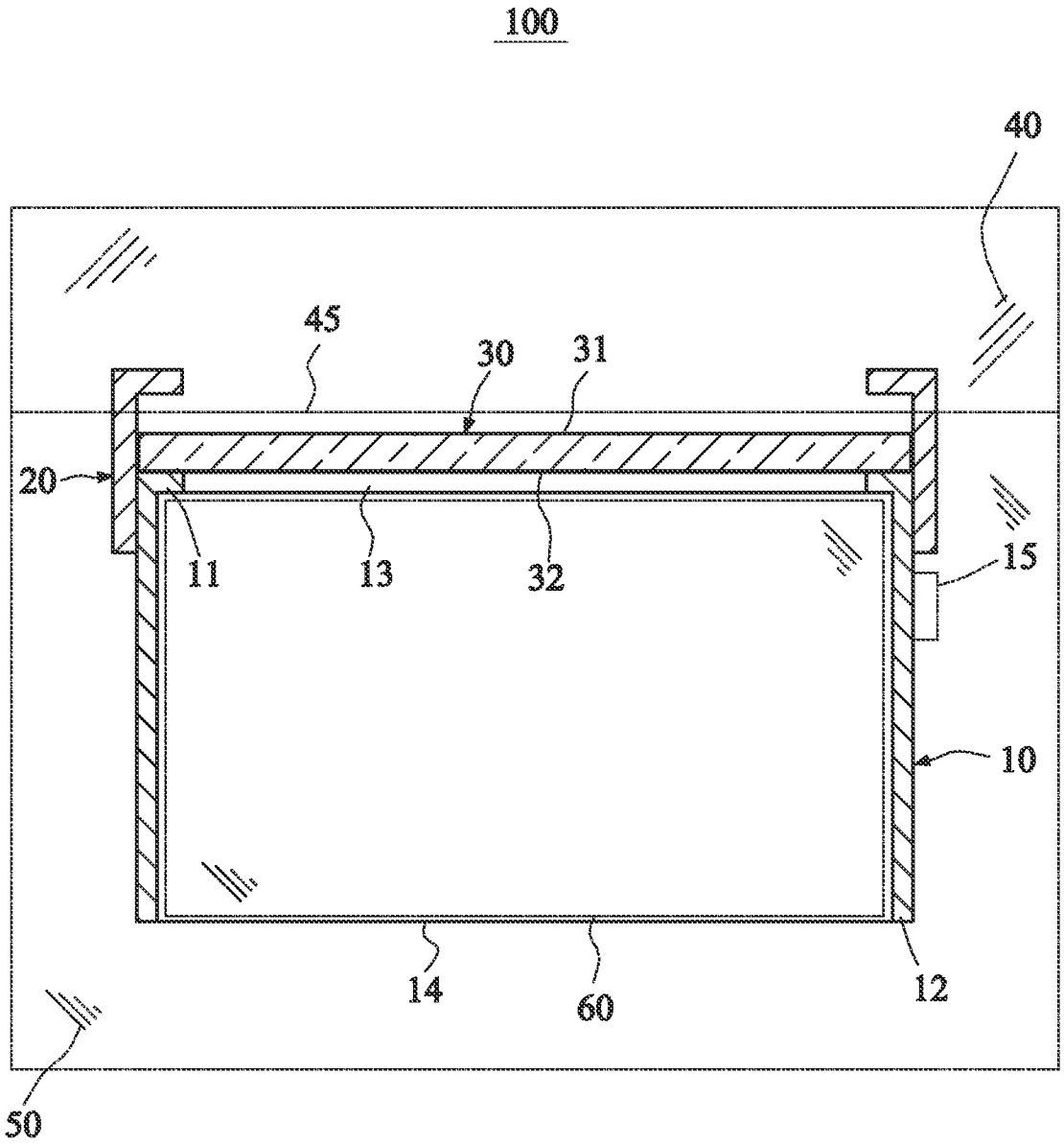
FIG. 1 is a schematically cross-sectional view showing a first state of a passive stabilizing device according to a preferred embodiment of this disclosure.
Figure 2:
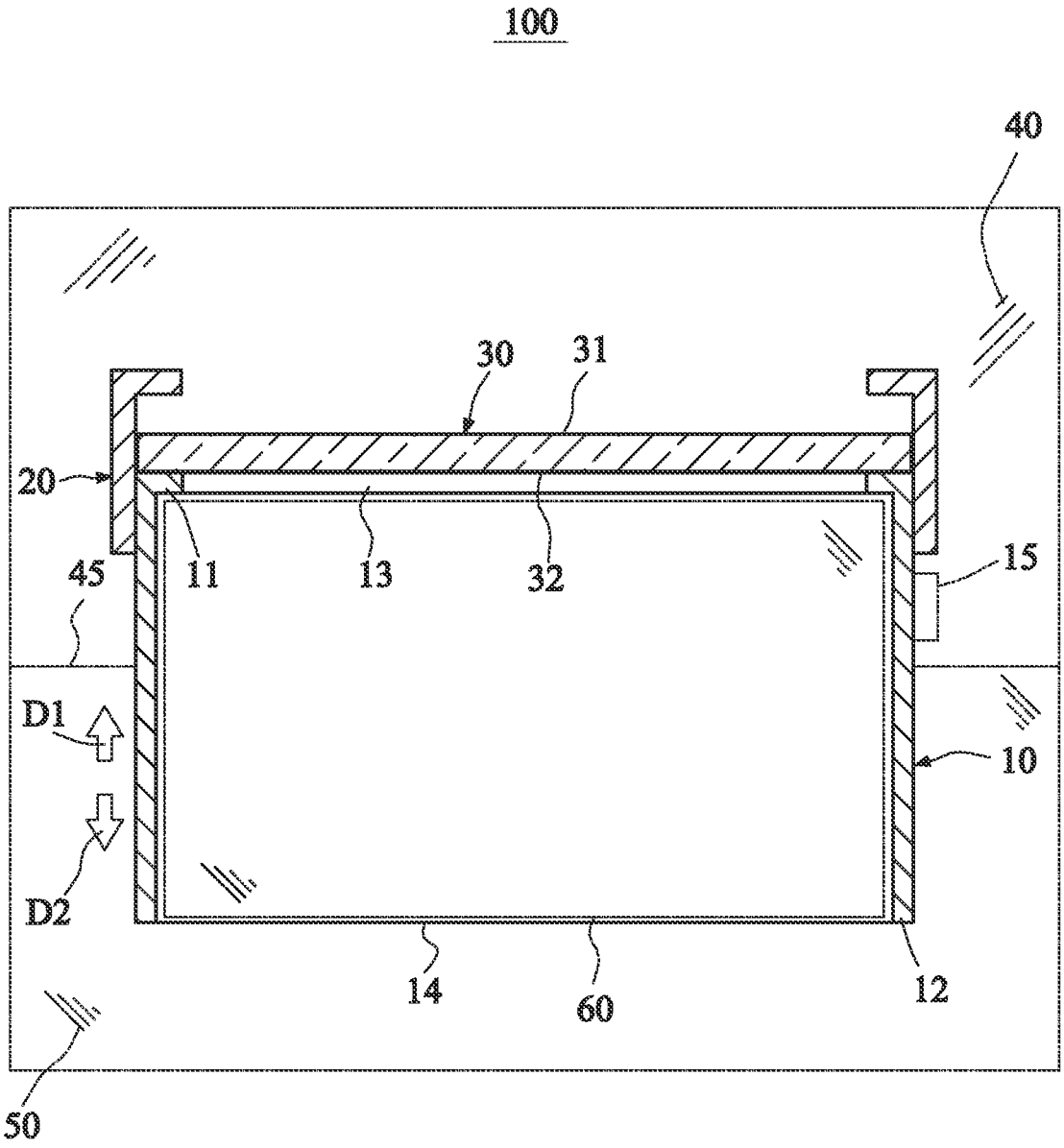
FIG. 2 is a schematically cross-sectional view showing a second state of the passive stabilizing device of FIG. 1.

FIGS. 1 and 2 are schematically cross-sectional views showing a first state and a second state of a passive stabilizing device according to a preferred embodiment of this disclosure. Referring to FIGS. 1 and 2, a power-free passive stabilizing device 100 includes a hollow chamber body 10, a limiting structure 20 and a valve cover 30, wherein each element may be made of a single material or a composite material.

The hollow chamber body 10 has a first end 11, a second end 12, a first opening 13 at the first end 11 and a second opening 14 at the second end 12. The limiting structure 20 is connected to the first end 11 of the hollow chamber body 10. The valve cover 30 is limited by the limiting structure 20 and movably disposed on the first end 11 of the hollow chamber body 10 to close and open the first opening 13. The hollow chamber body 10 further has a mounting part 15 to be mounted to an external structure to be explained subsequently.

Upon the actual operation, the passive stabilizing device 100 works or operates in the environment including a first medium 40 and a second medium 50. A density of the first medium 40 is smaller than a density of the second medium 50, and an interface 45 is formed between the first medium 40 and the second medium 50. In a non-restrictive example, the first medium 40 is air, and the second medium 50 is water, such as seawater, river water, lake water and the like, and the interface 45 is a horizontal surface. An operator may place the overall passive stabilizing device 100 from the air into the water with the second opening 14 facing downward. That is, when the second opening 14 of the hollow chamber body 10 is moved from the first medium 40 (air) to the second medium 50 (water) through the interface 45 (horizontal surface), the second medium 50 (water) squeezes the first medium 40 (air) in the hollow chamber body 10, so that the first medium 40 (air) pushes the valve cover 30 to open the first opening 13 and flows out of the first opening 13. Therefore, the passive stabilizing device 100 can be placed very smoothly under the actions of the atmosphere pressure and the gravity. More particularly, the operator can throw the passive stabilizing device 100 into the water. At this time, the state of the passive stabilizing device 100 is shown in FIG. 1. It is understandable that at least the valve cover 30 needs to be submerged into the interface 45 when the passive stabilizing device 100 is operating, so the overall limiting structure 20 may also be submerged into the interface 45.

When the state of the passive stabilizing device 100 is changed from FIG. 1 to FIG. 2 (i.e., when the unstable disturbance is present), a force is exerted to the hollow chamber body 10 or the limiting structure 20 so that the hollow chamber body 10 tends to leave the second medium 50. In other words, when the hollow chamber body 10 is forced such that the first opening 13 tends to move from the second medium 50 (water) to the first medium 40 (air) through the interface 45, the valve cover 30 closes the first opening 13, under the action of the pressure (e.g., atmosphere pressure) caused by the first medium 40, to utilize the second medium 50 in the hollow chamber body 10 to provide an auxiliary inertial mass 60 to stabilize the hollow chamber body 10 or keep the second medium 50 stable in the hollow chamber body 10, so that the state of the passive stabilizing device 100 is further changed from FIG. 2 to FIG. 1.

In a recycling state, the operator may exert a force to the valve cover 30 to lift up the valve cover 30 using or by way of, for example, a rope, a magnetic force, attraction or suction. In the condition when the magnetic force is applied, the valve cover 30 may include a magnetic material. Therefore, when the valve cover 30 is forced to open the first opening 13 and leave the interface 45, the valve cover 30 also lifts up the hollow chamber body 10 through the limiting structure 20. At this time, the first opening 13 is not closed any more, and this is equivalent to the lifting of a cylindrical tube having two end openings, wherein the water in the cylindrical tube is kept in the horizontal level, and is finally separated from the cylindrical tube. Therefore, the auxiliary inertial mass 60 in the hollow chamber body 10 gradually decreases, so that the passive stabilizing device 100 can entirely leave the second medium 50 without exerting a force to the auxiliary inertial mass 60. Therefore, the auxiliary inertial mass 60 is equivalent to the mass of the second medium 50 accommodated within the hollow chamber body 10, and can be smoothly abandoned or thrown away when the operator wants to recycle the passive stabilizing device 100.

The second opening 14 may have a circular shape, an elliptic shape or a polygonal shape. The area of the first opening 13 is smaller than the area of the second opening 14. That is, the first end 11 of the hollow chamber body 10 has an inner edge extending inwardly, so that the inner edge provides the downward pressing force to the second medium 50, or is supported by the second medium 50 and thus has the slightly stabilizing effect. However, this disclosure is not particularly restricted thereto.

In this example, the hollow chamber body 10 has multiple openings and can withstand the considerable pressure, and the valve cover 30 can also withstand the considerable pressure, cannot easily deform and has the light and thin property. The limiting structure 20 can prevent the valve cover 30 from escaping, and may have one or multiple limiting structures. For example, the limiting structure 20 may be mounted permanently by way of welding to the hollow chamber body 10, or may be removably mounted by way of screwing to the hollow chamber body 10. In the screwing occasion, a portion of the limiting structure 20 may be removed to facilitate the installation or replacement of the valve cover 30. In one example, another valve cover having a different density may be replaced with the valve cover 30 to achieve a different degree of sealing effect. Alternatively, a user may adjust the limit stroke of the limiting structure 20 so that the device is applicable to different dynamic environments.

In other words, before the passive stabilizing device 100 is initially used, the hollow chamber body 10 is full of the first medium 40 with the lower density. Then, the passive stabilizing device 100 reaches the interface 45. At this time, the interface 45, the hollow chamber body 10 and the valve cover 30 form a hermetic space, and the first medium 40 in the hollow chamber body 10 is compressed or squeezed under the action of the gravity and thus pushes the valve cover 30. Finally, the passive stabilizing device 100 is entirely submerged into the second medium 50 with the higher density, and the first medium 40 in the hollow chamber body 10 is replaced with the second medium 50. When the unstable condition is present to lift up the hollow chamber body 10, the pressure difference between the inside and the outside of the hollow chamber body 10 makes the valve cover 30 close naturally, so that the second medium 50 in the chamber body is lifted up when the hollow chamber body 10 is lifted up, and the weight of the second medium 50 (heavier) with the higher density provides the stabilizing effect. In one example, the density (or average density) of the valve cover 30 is greater than that of the second medium 50, and the density (or average density) of the hollow chamber body 10 is greater than that of the second medium 50. In another example, the density (or average density) of the hollow chamber body 10 is smaller than that of the second medium 50. At this time, the valve cover 30 tends to press down the hollow chamber body 10, and the hollow chamber body 10 tends to float up to cause the better sealing effect. Of course, the density (or average density) of the hollow chamber body 10 may also be designed to be substantially equal to that of the second medium 50.

Therefore, the characteristic of this disclosure resides in that the auxiliary inertial mass 60 mainly comes from the environment to assist in stabilization. When the passive stabilizing device 100 is not used, the overall mass is extremely small. Compared with the conventional ballasting method using the proof mass, the mass difference therebetween is extremely large to affect the portability. When the passive stabilizing device is to be recycled, it is only necessary to gently pull the valve cover 30 to disable the hermetic condition in the inner space, so that the recycle becomes easy. Because the structure is simplified, the cost is low.

Figure 3:
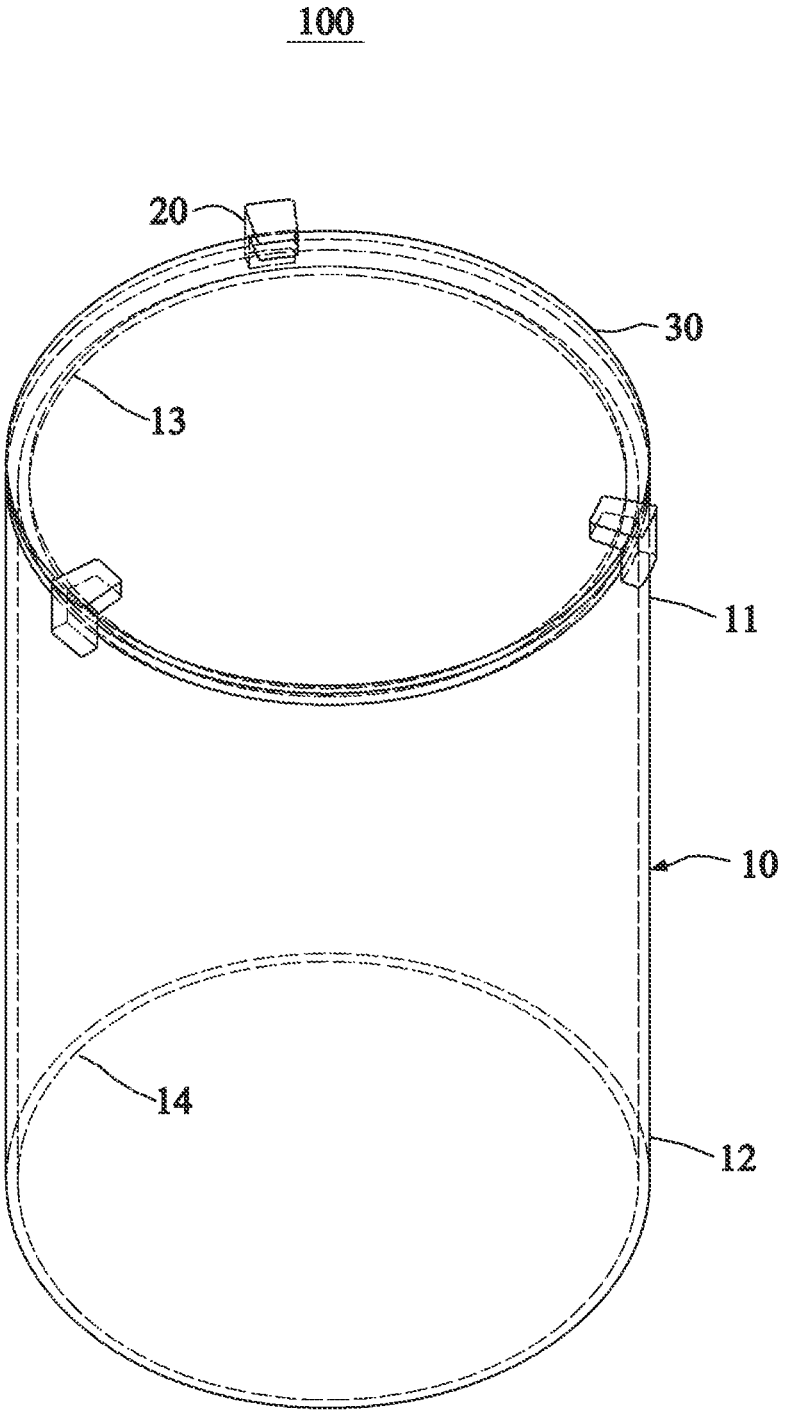
FIG. 3 is a pictorial view showing another example of the passive stabilizing device of FIG. 1.

FIG. 3 is a pictorial view showing another example of the passive stabilizing device of FIG. 1. Referring to FIG. 3, this example is similar to FIG. 1, wherein three limiting structures 20 are utilized, and the hollow chamber body 10 extends longitudinally in the vertical direction. Therefore, the shape and size of the hollow chamber body 10 are not particularly restricted.

Figure 4:
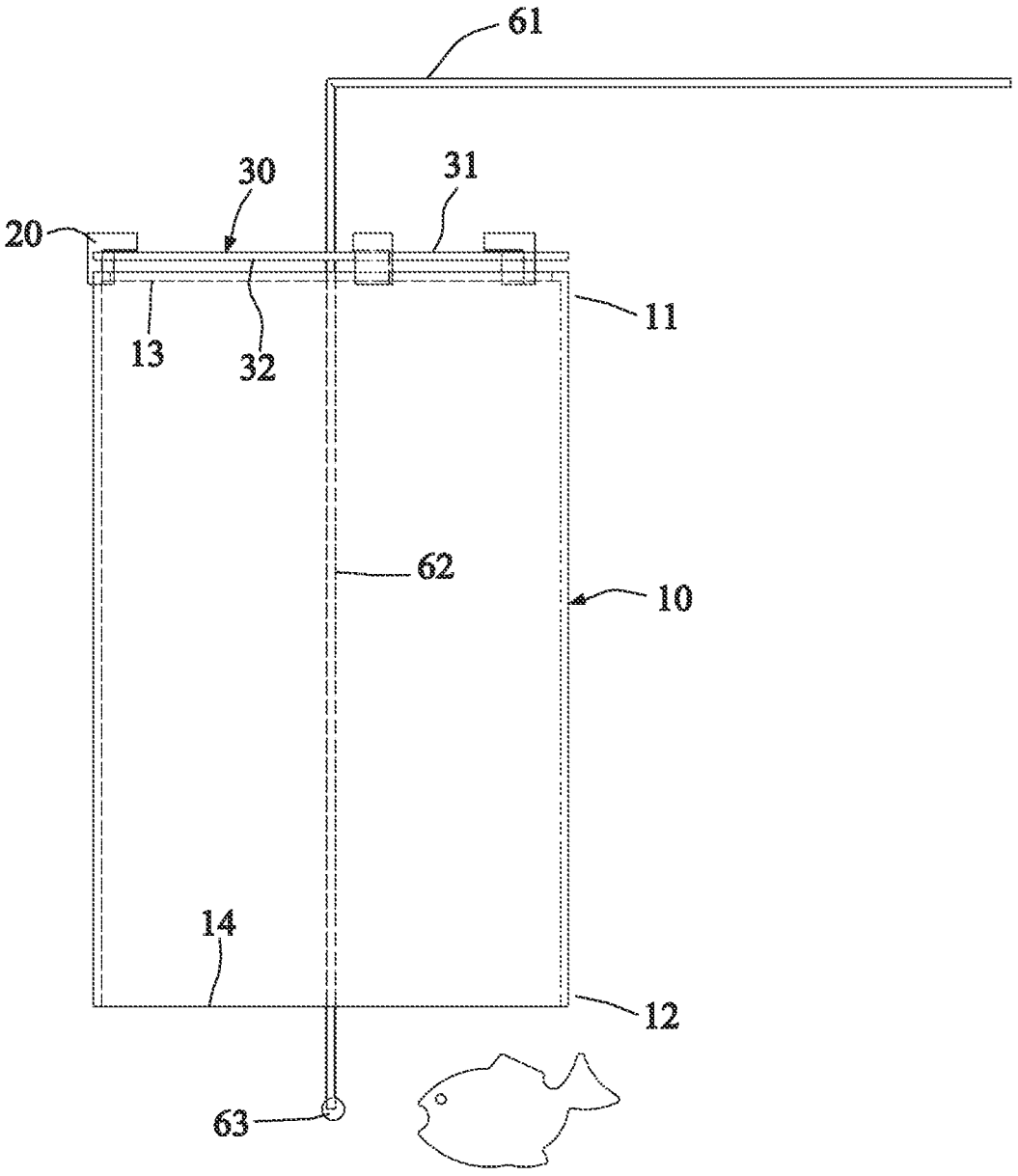
FIG. 4 is a schematic front view showing a modified example of the passive stabilizing device of FIG. 3.

FIG. 4 is a schematic front view showing a modified example of the passive stabilizing device of FIG. 3. Referring to FIG. 4, the passive stabilizing device 100 is a fishing tackle, and further includes a first line 61, a second line 62 and a hook 63. The first line 61 is connected to a first surface 31 of the valve cover 30. The second line 62 is connected to a second surface 32 of the valve cover 30. The second surface 32 may close the first opening 13. The hook 63 is connected to the second line 62, and is disposed away from the second surface 32. The limiting structure 20 of the fishing tackle may be entirely submerged into the water, so that it is hard for the fish (or any other to-be-fished creature) having been hooked to escape because the fish needs to drag the auxiliary inertial mass, thereby decreasing the force and loading of the fisherman for fighting the fish. After the fish becomes exhausted, the fisherman can pull up the valve cover 30 through the first line 61 so that the valve cover 30 touches the top of the limiting structure 20. At this time, the first opening 13 is opened. After the first opening 13 has entered the air, the auxiliary inertial mass does not provide the function to the passive stabilizing device 100 any more so that the fisherman can conveniently get the fish and the fishing tackle.

Figure 5:
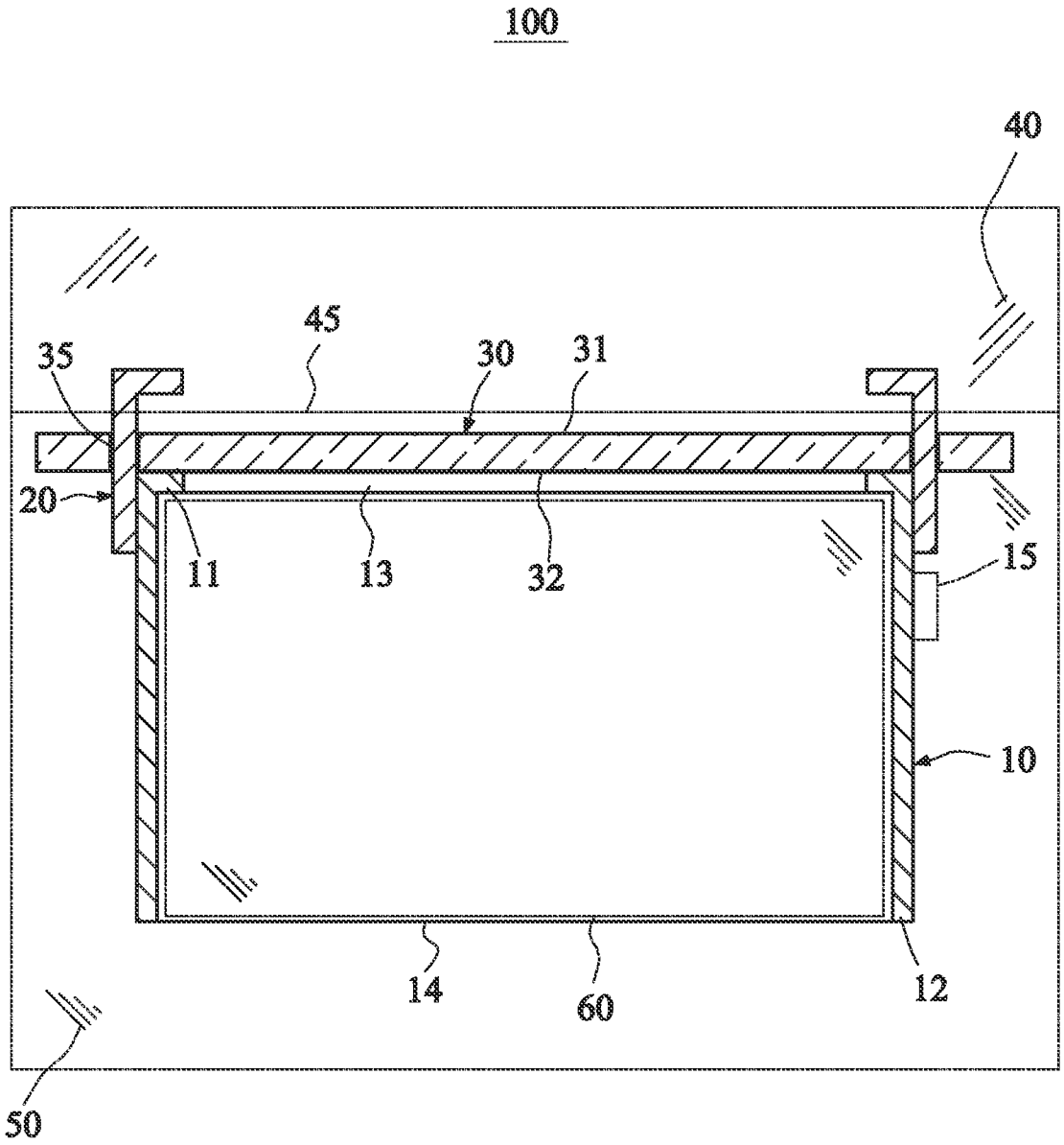
FIG. 5 is a schematically cross-sectional view showing still another example of the passive stabilizing device of FIG. 1.

FIG. 5 is a schematically cross-sectional view showing still another example of the passive stabilizing device of FIG. 1. Referring to FIG. 5, a size of the valve cover 30 orthogonally projected onto the interface 45 is greater than a size of the hollow chamber body 10 orthogonally projected onto the interface 45. Consequently, the structure having the large upper portion and the small lower portion can be provided, and this is advantageous to the self stabilization. In addition, the valve cover 30 includes a guide structure 35. The guide structure 35 and the limiting structure 20 cooperate with each other to guide the valve cover 30 to move in a direction perpendicular to the interface 45 relatively to the limiting structure 20 so that the valve cover 30 can be smoothly opened or closed, and it is also possible to prevent the valve cover 30 from being arbitrarily moved. It is understandable that the guide structure 35 is also applicable to the example of FIG. 1, and other types of guide structures may also be designed to achieve the guiding effect.

Figure 6:
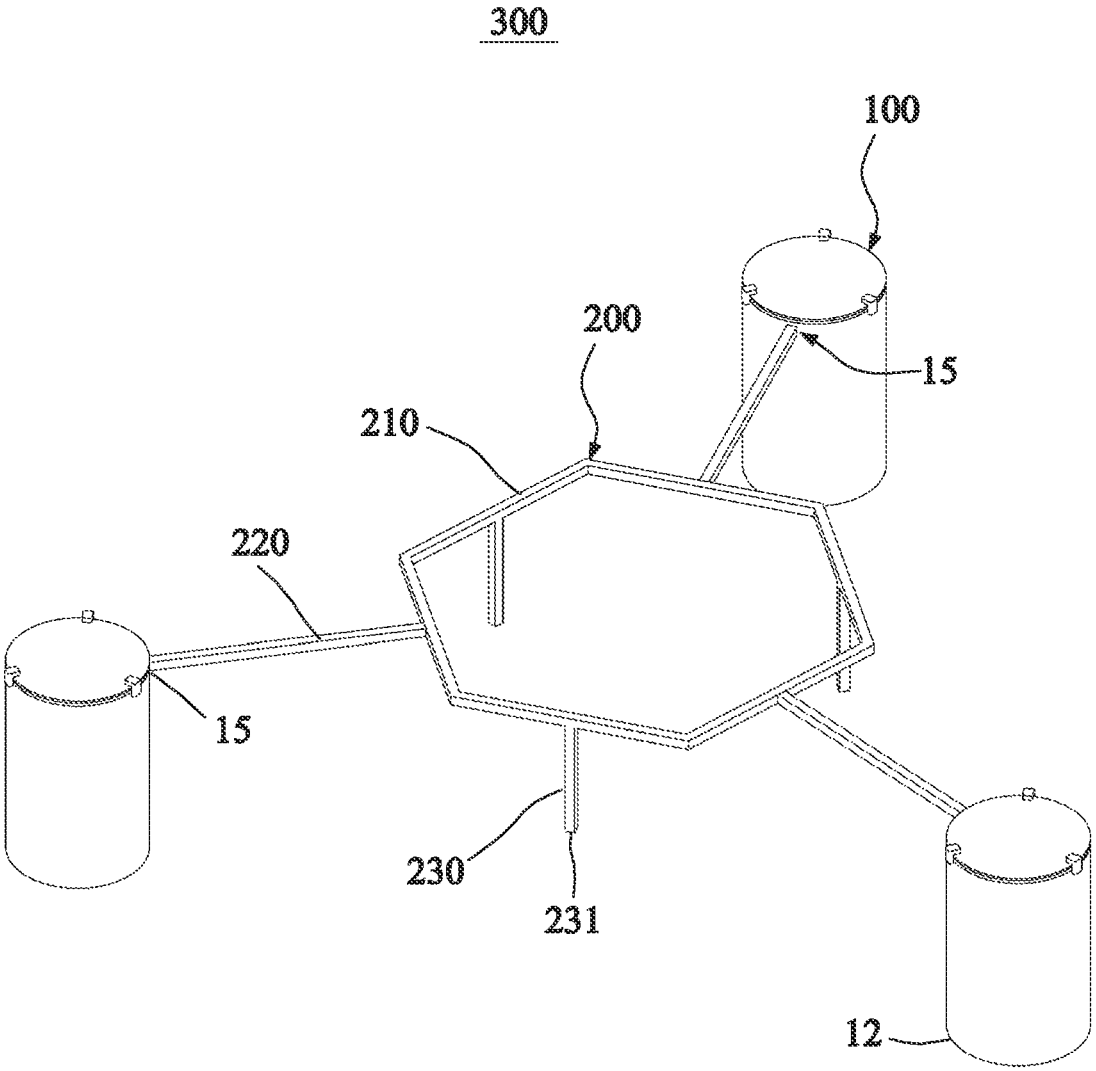
FIG. 6 is a pictorial view showing a passive stabilizing system using the passive stabilizing device of FIG. 3.

FIG. 6 is a pictorial view showing a passive stabilizing system using the passive stabilizing device of FIG. 3. Referring to FIG. 6, a power-free passive stabilizing system 300 includes a frame structure 200 and multiple passive stabilizing devices 100. The passive stabilizing device 100 is mounted on the frame structure 200 through the mounting part 15 thereof. The frame structure 200 exerts a force to the hollow chamber body 10 under the unstable disturbance so that the first opening 13 tends to move from the second medium 50 to the first medium 40 through the interface 45. The passive stabilizing device 100 can resist the unstable disturbance to keep the stable state.

In this example, the frame structure 200 includes a frame body 210, multiple horizontal arms 220 and multiple vertical pillars 230. The frame body 210 may have a polygonal shape, a circular shape or an elliptic shape. The frame body 210 may be a portion of a water carrier (e.g., a boat, a refuge float, a buoy and the like). The horizontal arms 220 are mounted on the frame body 210 and the power-free passive stabilizing device 100 to enhance the stability benefit. The vertical pillars 230 are mounted on the frame body 210. Free ends 231 of the vertical pillars 230 and the second ends 12 of the hollow chamber bodies 10 are disposed on the same plane, so that the frame body 210 can be well supported to prevent the horizontal arms 220 from significant deformation or breaking when the passive stabilizing system 300 is being manufactured on the land. When the frame structure 200 tends to tilt down toward one side, the opposing side tends to leave the water level. At this time, the passive stabilizing device 100 on the opposing side provides the stabilizing effect by the weight approaching the weight of the water corresponding to the volume of the hollow chamber body 10. The tilting side of the passive stabilizing system 300 also provides the upward buoyancy due to the increased volume submerged into the water. So, both sides function concurrently to provide the stable balancing effect. The above-mentioned structure is also applicable to a platform of an ocean wind power generator. The ocean wind power generator needs to be submerged into the water at a greater depth, and usually needs a larger area of the platform and various auxiliary mechanisms to provide the stabilization. If the passive stabilizing system 300 of this disclosure is used, the passive stabilizing system 300 can assist in stabilizing the platform of the ocean wind power generator in the condition of using the smaller area of the platform. It is understandable that the passive stabilizing device may also be mounted on the frame structure through the limiting structure, and then a driving mechanism capable of providing a magnetic force, a vacuuming force, a pulling force or any other driving power is mounted on the frame structure. When needed, the driving mechanism can be controlled to drive the valve cover away from the first opening, and this is beneficial to lifting the overall passive stabilizing system off the second medium for maintenance. In this case, one or multiple passive stabilizing devices may be mounted on the frame structure.

It is worth noting that all the above embodiments can be combined, replaced or modified interactively as appropriate to satisfy the diversified requirements.

Therefore, the spirit of this disclosure is to provide a passive stabilizing device, which has an anti-overturn mechanism that can be easily carried to provide the great stabilizing effect, and can also drain the medium obtained from the environment, so that the overall mechanism is extremely light weighted and can be conveniently carried. In addition, the stabilization can be applied to a sea refuge float, a boat, a ship, an ocean wind power generator and the like requiring to keep the enhanced stability on the water. In addition, this passive stabilizing device may also be applied to a fishing tackle, so that the fisherman needs not to work hard to fight the fish after the fish is hooked. Instead, this passive stabilizing device provides the huge mass so that it is hard for the hooked fish to escape, and the passive stabilizing device still has the low cost and the lightweight, and can be conveniently carried and save the manpower.

The specific embodiments proposed in the detailed description of this disclosure are only used to facilitate the description of the technical contents of this disclosure, and do not narrowly limit this disclosure to the above-mentioned embodiments. Various changes of implementations made without departing from the spirit of this disclosure and the scope of the claims are deemed as falling within the following claims.

The invention claimed is:

1. A power-free passive stabilizing device working in an environment comprising a first medium and a second medium, wherein a density of the first medium is smaller than a density of the second medium, and an interface is formed between the first medium and the second medium, the power-free passive stabilizing device comprising:

a hollow chamber body having a first end, a second end, a first opening at the first end and a second opening at the second end;

a limiting structure connected to the first end of the hollow chamber body; and a valve cover limited by the limiting structure and movably disposed on the first end of the hollow chamber body to close and open the first opening, wherein when the second opening of the hollow chamber body is moved from the first medium to the second medium through the interface, the second medium squeezes the first medium in the hollow chamber body, so that the first medium pushes the valve cover to open the first opening and flows out of the first opening; and when the hollow chamber body is forced such that the first opening of the hollow chamber body tends to move from the second medium to the first medium through the interface, the valve cover closes the first opening to utilize the second medium in the hollow chamber body to provide an auxiliary inertial mass to keep the hollow chamber body stable in the second medium.

2. The power-free passive stabilizing device according to claim 1, wherein:

when the valve cover is forced to open the first opening and leaves the interface, the auxiliary inertial mass in the hollow chamber body gradually decreases, so that the power-free passive stabilizing device can entirely leave the second medium without exerting a force to the auxiliary inertial mass.

3. The power-free passive stabilizing device according to claim 2 being a fishing tackle, further comprising:

a first line connected to a first surface of the valve cover;

a second line connected to a second surface of the valve cover capable of closing the first opening; and a hook connected to the second line and disposed away from the second surface.

4. The power-free passive stabilizing device according to claim 1, wherein the hollow chamber body further has a mounting part to be mounted to a frame structure, which exerts a force to the hollow chamber body under unstable disturbance so that the first opening tends to move from the second medium to the first medium through the interface.

5. The power-free passive stabilizing device according to claim 1, wherein a density of the valve cover is greater than the density of the second medium.

6. The power-free passive stabilizing device according to claim 1, wherein a size of the valve cover orthogonally projected onto the interface is greater than a size of the hollow chamber body orthogonally projected onto the interface.

7. The power-free passive stabilizing device according to claim 1, wherein the valve cover comprises a guide structure, and the guide structure and the limiting structure cooperate with each other to guide the valve cover to move in a direction perpendicular to the interface relatively to the limiting structure.

8. A power-free passive stabilizing system, comprising:

a frame structure; and one or multiple ones of the power-free passive stabilizing device according to claim 1 mounted to the frame structure.

9. The power-free passive stabilizing system according to claim 8, wherein the frame structure comprises:

a frame body;

horizontal arms mounted on the frame body and the power-free passive stabilizing devices; and vertical pillars mounted on the frame body, wherein free ends of the vertical pillars and the second ends of the hollow chamber bodies are disposed on a same plane.

* * * * *